United States Patent [19]

Winden

[11] 4,450,974

[45] May 29, 1984

[54] LITTER CONTAINER

[75] Inventor: Joseph Winden, Grand Rapids, Mich.

[73] Assignee: Urban Systems Streetscape, Inc., Grand Rapids, Mich.

[21] Appl. No.: 419,148

[22] Filed: Sep. 17, 1982

[51] Int. Cl.[3] ..... B65D 43/18; B65D 23/00

[52] U.S. Cl. ..... 220/1 T; 220/336

[58] Field of Search ..... 220/1 T, 18, 336

[56] References Cited

U.S. PATENT DOCUMENTS 1,230,623 6/1917 Teven ..... 220/336

*Primary Examiner*—George T. Hall

*Attorney, Agent, or Firm*—Price, Heneveld, Huizenga & Cooper

[57] ABSTRACT

A litter container is provided that is particularly adapted for use in urban environments. A base is secured to a support surface with a first bolt ring that is disposed on an interior diameter of the base. A body is disposed atop the base for receiving a litter can and shielding the bolt ring from the view of ordinary observers. A second bolt ring is provided for securing the body to the base. The second bolt ring being disposed on the outer diameter of the base and engaging the underside of the body to shield the second bolt ring from view. A top is provided which is pivotally mounted to the base about a vertical axis. A stop is provided for holding the top in vertical alignment with the base and one or more doors are disposed in the top, the stop and the pivotal mechanism for the doors being shielded from view. The base is provided with multiple mounting apertures so that the litter container can be mounted at various angular orientations.

19 Claims, 17 Drawing Figures

LITTER CONTAINER

BACKGROUND OF THE INVENTION

The invention relates generally to litter containers and more particularly, is directed to a litter container particularly adapted for use in large urban environments.

Litter containers are known in the prior art. Normally, these containers comprise an upstanding body for receiving a litter can, plastic bag, or the like, and a top disposed above the base having one or more spring loaded doors disposed therein. In large urban environments, such litter cans are a necessity for collecting and temporarily storing the refuse of pedestrian and vehicular traffic. However, in such an environment, these litter containers often become the object of vandals who turn over the containers and/or otherwise damage the containers so as to detract from their function and aesthetic appearance.

SUMMARY OF THE INVENTION

These and other problems are solved in the prior art by provision of a vandal resistant and aesthetically pleasing litter container for use in an urban environment. The container comprises a base having inner and outer diameters, and a first bolt ring for securing the base to a support surface so that the litter container cannot be turned over. The first bolt ring is disposed on the inner diameter of the base and a body is disposed atop the base for shielding the first bolt ring from the view of the ordinary observer. A second bolt ring is disposed on the exterior diameter of the base for engaging the underside of the base and securing the body to the base in a manner that shields the second bolt ring from view. A top is provided having one or more doors which extend coextensively with the sides of the top and which are pivotally mounted about generally horizontal axes disposed on the interior of the top such that the pivot point is shielded from view. The top is pivotally mounted atop the body about a vertical shaft which is disposed on one side of the litter container. A stop and spring clip for vertically orienting the top relative to the body is disposed on the other side of the container opposite the pivot point and between the top and body of the litter container such that the stop and spring clip is partially out of view. The base is provided with a circular array of apertures which is provided with a number of apertures that is a multiple of the number of apertures in the second bolt ring such that the angular orientation of the litter container is variable.

DESCRIPTION OF THE PREFERRED EMBODIMENTS

Figure 1:
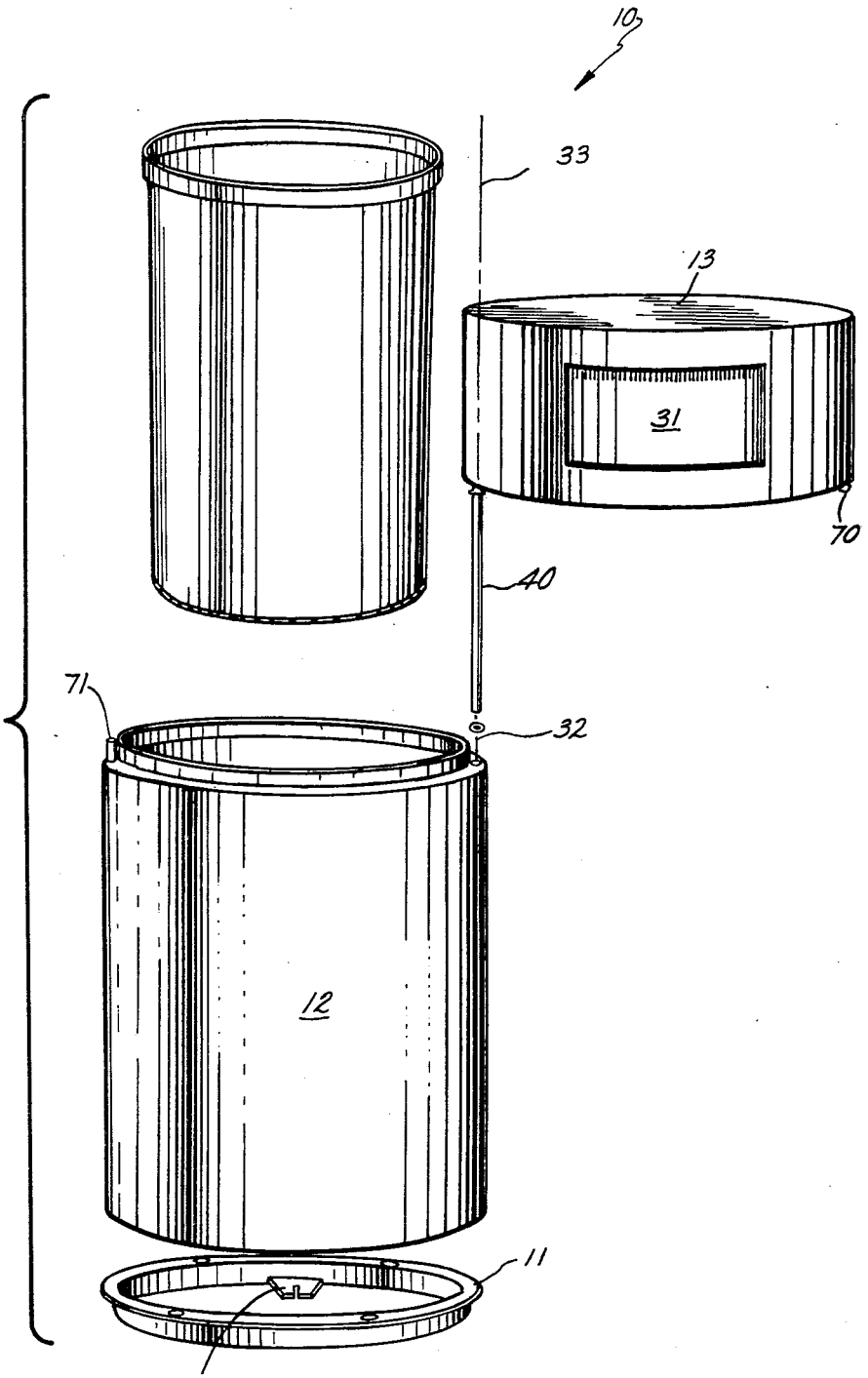
FIG. 1 is an exploded assembly of the litter container of the present invention.
Figure 2:
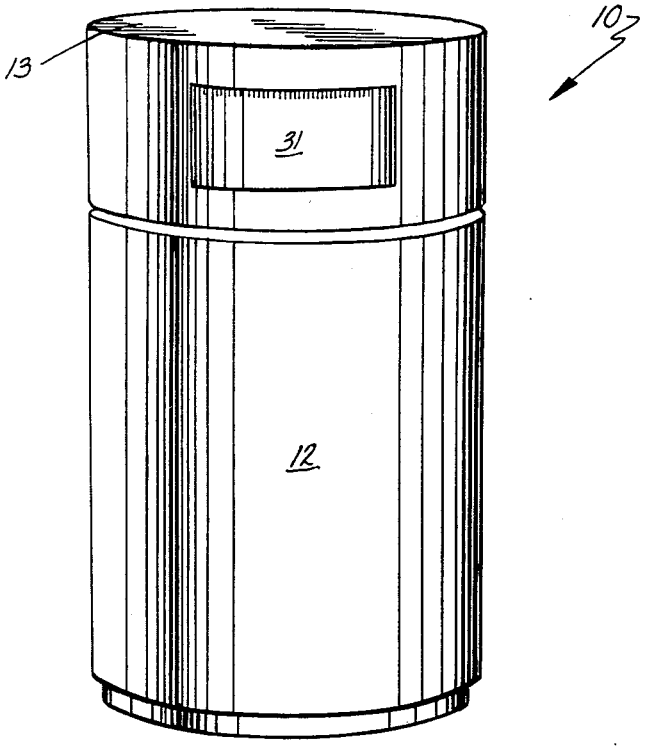
FIG. 2 is a perspective view of the litter container of the present invention.
Figure 3:
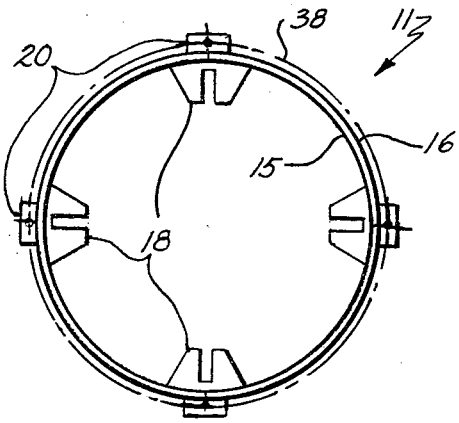
FIG. 3 is a plan view of the base member of the litter container of the present invention.

With reference now to FIGS. 1 and 2, the litter container of the present invention is generally illustrated at 10. The litter container 10 comprises a base 11, a body 12 and a top 13. With reference now also to FIG. 3, it is illustrated that the base 11 is provided with inner and outer diameters 15 and 16, respectively. Means for securing the base 11 to a support surface is disposed on the inner diameter 15 comprising a first bolt ring 18. The body 12 is disposed atop the base 11 such that the first bolt ring 18 is shielded from the view of the ordinary observer and thus, it is difficult, if not impossible, for the litter container to be released from its mounting and turned over. The base 11 is provided with means for securing the body thereto comprising a second bolt ring 20 disposed on the exterior diameter thereof. In FIG. 1, the second bolt ring 20 is formed on a flange which extends continuously around the periphery of the base 11 whereas in the plan view in FIG. 3, the second bolt ring 20 is disposed on a plurality of tabs which extend radially from the exterior of the base 11. Functionally, the bolt rings illustrated in FIGS. 1 and 2, are equivalent. The second bolt ring 20 engages the underside of the base 12 such that the bolts 22, illustrated in FIG. 4, which secure the body 12 atop the base 11 are shielded from the eye of the ordinary observer. Further, the sidewall of the base 12 is provided with a portion 23, best illustrated in FIG. 4, which extends below the underside or lower surface 24 of the base 12 to further shield the fasteners which extend through the second bolt ring 20. The body 12 receives a litter receptacle 30 for receiving and storing refuse which is pushed through one or more doors 31 disposed in the top 13. The top 13 is pivotally mounted atop the body 12 about a vertical axis 33. The means for pivotally mounting the top 13 on the body 12 comprises a vandal resistant hinge 35, best illustrated in FIG. 4.

Figure 5:
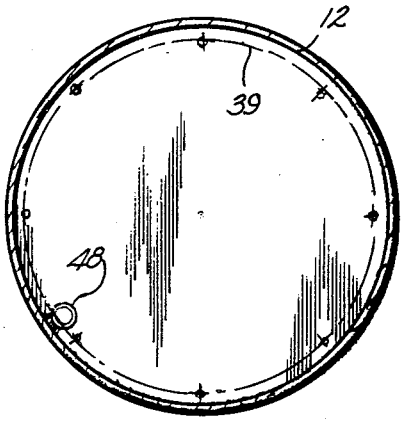
FIG. 5 is a plan view in section of the body of the litter container of the present invention.

With reference to FIGS. 3 and 5, it is illustrated that the second bolt ring 20 comprises a first circular array of apertures 38 disposed on a continuous flange or a plurality of flanges which extend from the exterior of the base 11. The first circular array of apertures 38 cooperate with a second circular array of apertures 39 which are disposed in the underside of the body 12. When apertures in the first and second arrays are aligned, through fasteners such as bolts, or the like, may be used for securing the body 12 atop the base 11. One of the first and second circular arrays of apertures may be provided with a number of apertures that equals a multiple of the number of apertures disposed in the other of the first and second circular arrays such that the angular orientation of the litter container may be varied. In this case, the first circular array is provided with four apertures and the second circular array is provided with eight apertures engaged by four through bolts which permit positioning of the litter container at various angular orientations which differ in increments of 45°. The angular orientation of the litter container could be similarly varied by providing first and second arrays with eight or another similarly large number of apertures. Also, similarly, the first bolt ring 18 could be provided with a larger number of apertures, however, the first bolt ring 18 is normally inaccessible and in either case, increasing the number of apertures disposed in the first and second bolt rings 18 and 20, is not as cost effective as providing a multiplicity of apertures in the base 12.

Figure 6:
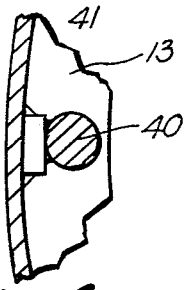
FIG. 6 is a sectional view of the hinge member of the litter container of the present invention taken along line VI—VI in FIG. 4.
Figure 13:
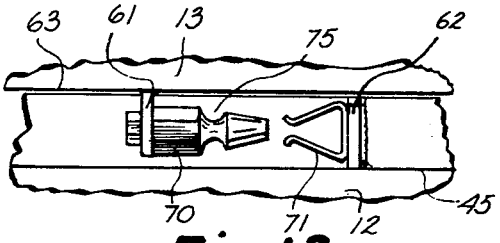
FIG. 13 is an elevational view of a combination stop and spring clip for limiting the relative motion of the top and the base of the litter container of the present invention.
Figure 7:
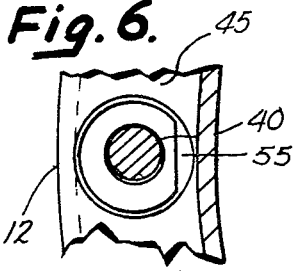
FIG. 7 is a sectional view of the hinge member of the litter container of the present invention taken along line VII—VII in FIG. 4.
Figure 14:
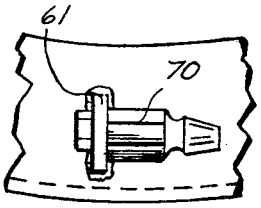
FIG. 14 is a bottom view of a male striker member forming a portion of the combination stop and spring clip illustrated in FIG. 13.
Figure 15:
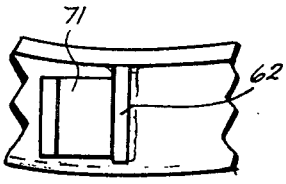
FIG. 15 is a top view of a female spring clip means forming a portion of the combination stop and spring clip illustrated in FIG. 13.
Figure 8:
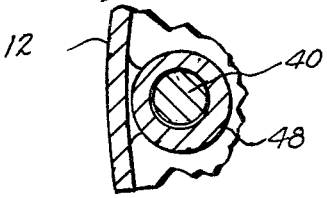
FIG. 8 is a sectional view of the hinge member of the litter container of the present invention taken along line IIX—IIX in FIG. 4.
Figure 11:
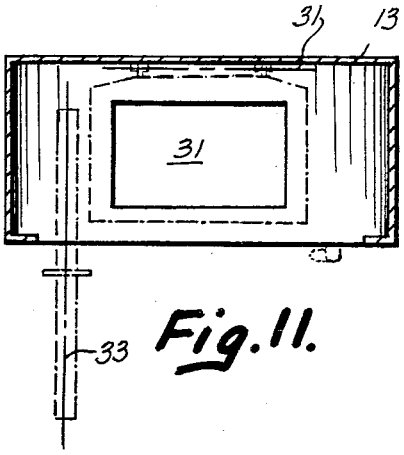
FIG. 11 is an elevational view in section of the top member of the litter container of the present invention.
Figure 12:
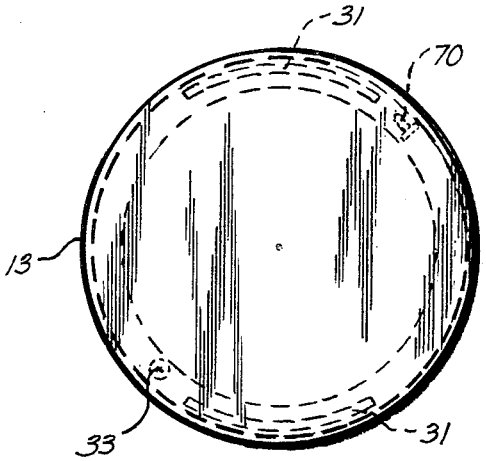
FIG. 12 is a top view of the top member of the litter container of the present invention.
Figure 10:
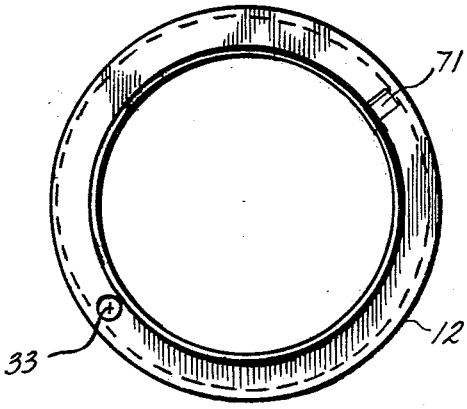
FIG. 10 is a top view of the base member of the litter container of the present invention.
Figure 9:
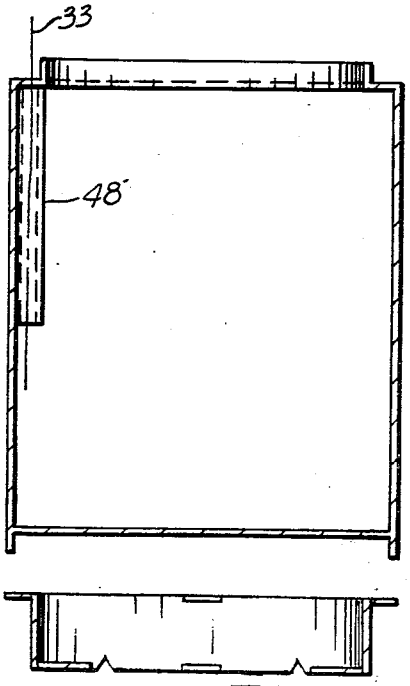
FIG. 9 is an elevational view, partially in section, of the body and base member of the litter container of the present invention.
Figure 4:
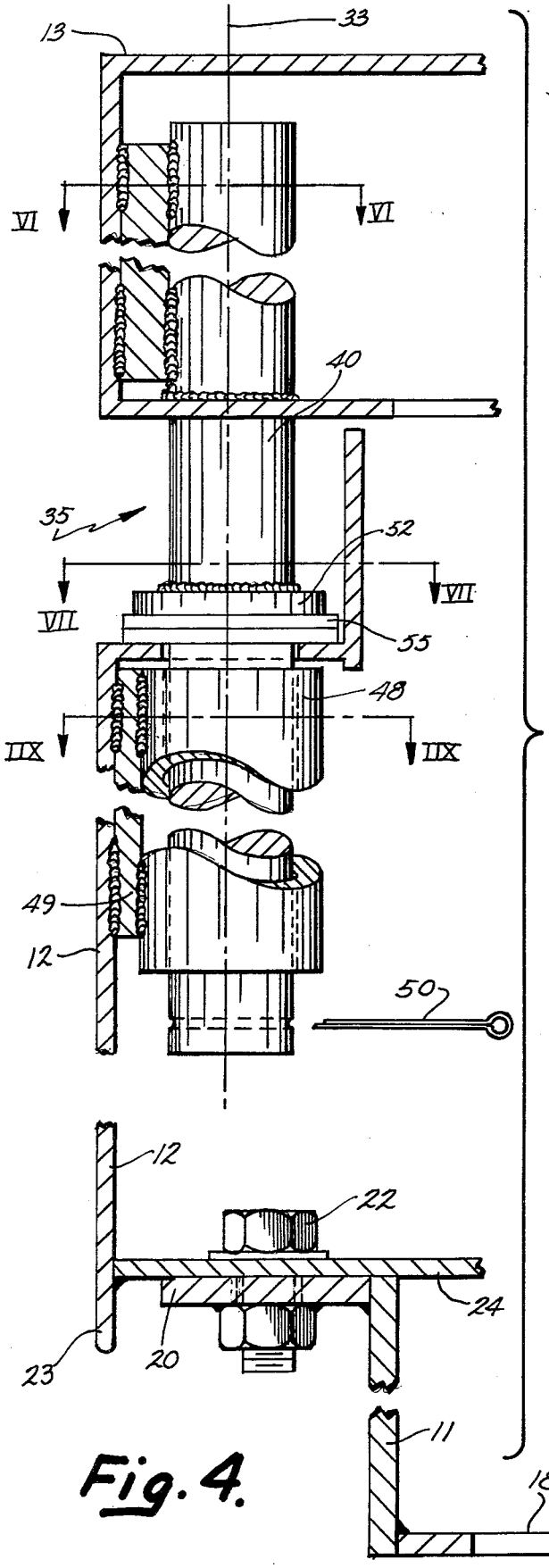
FIG. 4 is an elevational view, partially in section, of one sidewall including the hinge member of the litter container of the present invention.
Figure 16:
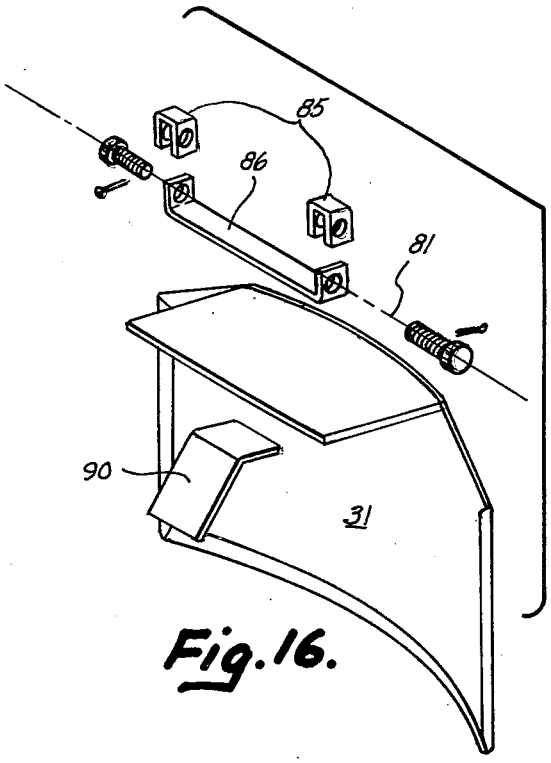
FIG. 16 is an exploded assembly of a door of the litter container of the present invention.
Figure 17:
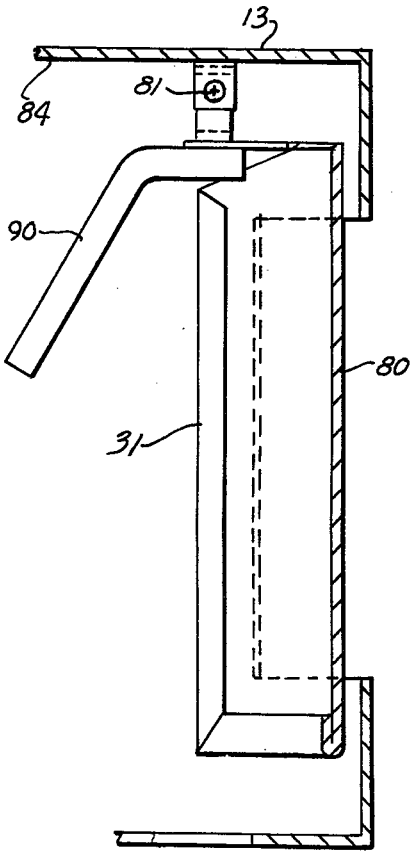
FIG. 17 is an elevational view, partially in section, of a door of the litter container of the present invention.

With reference again to FIGS. 1 and 2, preferably both the top 13 and the body 12 comprise right circular cylinders which are pivotable relative to one another about a generally vertical axis 33 to permit access to the interior of the body 12. This arrangement presents a litter container that is both aesthetically pleasing and which incorporates a vandal resistant hinge structure 35 which, with reference now also to FIG. 4, comprises a generally vertically oriented shaft 40 which is secured to the interior of the top 13. With reference now also to FIG. 6, it is illustrated that the shaft 40 is welded or otherwise suitably secured to the side of the top 13 with a spacer member 41 disposed therebetween for positioning the shaft 40 relative to the top 13. The shaft 40 projects downwardly in a vertical direction from the top 13 and is journaled within the body 12. With reference now also to FIGS. 7 through 9, it is illustrated that the shaft 40 extends through an upward facing surface 45 disposed on the top of the base 12 and into a tubular sleeve 48 which is welded or otherwise suitably secured to the side of the base 12 with a spacer 49, illustrated only in FIG. 4, extending therebetween as required for positioning the tube 48 relative to the base 12. As best illustrated in FIG. 4, once the shaft 40 is inserted in the tubular sleeve 48, means for engaging the bottom of the shaft 40 such as a cotter pin 50, is provided for preventing withdrawal of the shaft 40 from the tubular sleeve 48 and thus preventing removal and subsequent loss of the top 13 of the litter container. Means for defining a horizontally extending shoulder is disposed on the shaft 40 at 52 comprising a metallic washer welded or otherwise suitably secured to the shaft 40. The washer 52 defines a horizontally extending shoulder, which through interference with the upwardly facing surface 45 of the base 12, defines the proper vertical height of the top 13 relative to the base 12. One or more plastic washers 55 are disposed between the metallic washer 52 and the surface 45 of the base 12. The washers 55 are preferably formed from a lubricious plastic, such as Teflon, for reducing the coefficient of friction between the top 13 and the body 12 and thus lessening the amount of resistance necessary to pivot the top 13 relative to the body 12. Also, the number of washers 55 may be varied to adjust the clearance between the body 12 and the top 13. This unique hinge structure is sturdy and effective for pivotally mounting the top 13 relative to the body 12 and yet is substantially enclosed within the interior of the top 13 and body 12 and inaccessible to the ordinary observer. One must open the container and remove the receptacle 30 before even the nature of the hinge 35 is evident. If an arrangement for locking the top 13 relative to the body 12 is provided, the hinge structure 35 becomes completely inaccessible to all but the most persistent vandals.

With reference now to FIGS. 1 and 9–15, it is illustrated that means for defining a stop which limits the pivotable motion of the top 13 relative to the body 12, is provided for vertically aligning the same into the right circular cylindrical configuration best illustrated in FIG. 2. More particularly, in FIGS. 13 through 15, it is illustrated that first and second generally vertically oriented abutments 61 and 62 are disposed on a lower surface 63 of the top 13 and the upwardly facing surface 45 of the base 12, to define a motion limit for the pivotal motion of the top 13 relative to the base 12 through interference of the same. The abutments 61 and 62 may be apertured and may be provided with a padlock or other similar locking device for denying vandals access to the interior of the litter container 10. However, in the embodiment illustrated herein, the stop further comprises a spring clip for releasably latching the top in vertical alignment relative to the base. More particularly, in this case, the spring clip comprises a male striker member 70 disposed on the first abutment 61 and extending generally horizontally therefrom and a bifurcated leaf spring clip 71 mounted on the second abutment 62. The striker 70 includes an annular groove 75 which is engaged by opposing spring clip arms of bifurcated spring clip 71 for latching the top 13 in the closed position in vertical alignment with the base 12.

As best illustrated in FIGS. 1, and 9 through 12, the vertical axes 33 about which the top 13 is pivotable relative to the body 12 is disposed on one side of the litter container 10 and the stop means, or in this case, the male striker 70 and female spring clip 71, are disposed on the opposite side of the litter container, 180° opposite the vertical axis 33. With the male striker 70 and the female spring clip 71 disposed on downwardly and upwardly facing surfaces of the top 13 and the body 12, respectively, the combination stop and spring clip means extends therebetween in an area where it is not readily observable by the ordinary observer and thus even where a locking arrangement is not provided for securely locking the top 13 relative to the body 12, the method of obtaining access to the interior of the litter container is not readily discernible to the ordinary observer.

With reference now to FIGS. 1, 11, 12, 16 and 17, it is illustrated that the top 33 is provided with one or more doors 31 which present a surface 80 which extends approximately coextensively with the sides of the top 13. Preferably, the door 31 is pivotally mounted about a generally horizontal axis 81 on the interior of the top 13. In this case, the door 31 is pivotally mounted to the top surface 84 of the interior of the top 13 with U-shaped brackets 85 and 86 which are spot welded or otherwise suitably secured to the top 13 and the door 31. Bolts or other suitable fasteners, not illustrated herein, extend through the U-shaped brackets 85 and 86 to complete the hinge connection and pivotally mount the door 31 about the axis 81. This provides a door 31, which is gravity biased into the closed position, and effectively shields the hinge mechanism for the door 31 from the view of the ordinary observer. An angled member 90 defines a rotation stop for the pivotable door 31 by engaging the surface 84 of the interior of the top 13. The angled member 90 may also be weighted in a suitable fashion to increase the gravity bias of the door 31 to the closed position.

The above description should be considered exemplary and that of the preferred embodiment only. Other modifications of the invention will occur to those who make and use the invention. The true scope and spirit of the invention is to be determined with reference to the appended claims and it is desired to include within the present invention all such modifications of the invention that come within the proper scope of the claims.

The embodiments of the invention in which an exclusive property or privilege is claimed are defined as follows:

1. A litter container for use in an urban environment comprising:

a base having inner and outer diameters;

means for securing said base to a support surface disposed on said inner diameter;

a body disposed atop said base for receiving a litter receptacle, and shielding said means for securing said base from the view of the ordinary observer;

means for securing said body to said base disposed on said outer diameter and engaging the underside of said body for shielding said means for securing said body from the view of the ordinary observer;

a top; and means for pivotally mounting said top on said body.

2. The litter container of claim 1 wherein said body is provided with generally vertical sides which extend below the underside of said body for shielding said means for securing said body from the view of the ordinary observer.

3. The litter container of claim 1 wherein said means for securing said body to said base comprises a first circular array of apertures and said underside of said body is provided with a second circular array of apertures, one of said first and second arrays of apertures being provided with a number of apertures equaling a multiple of the number of apertures disposed in the other of said first and second arrays for varying the angular orientation of said body relative to said base.

4. The litter container of claim 1 wherein said body and said top comprise a right circular cylinder.

5. The litter container of claim 1 wherein said means for pivotally mounting said top on said body comprises a hinge for pivoting said top away from said body about a generally vertical axis.

6. The litter container of claim 5 wherein said hinge comprises a generally vertical shaft secured to said top and journaled in said body.

7. The litter container of claim 6 wherein said hinge further comprises a generally vertical tubular sleeve disposed in said body for slidably receiving said shaft.

8. The litter container of claim 7 wherein said hinge further comprises means for engaging said shaft, disposed on the bottom thereof for preventing withdrawal of said shaft from said tubular sleeve once said shaft is inserted therein.

9. The litter container of claim 6 wherein said hinge further comprises means for defining a shoulder disposed on said shaft for engaging said body and vertically locating said top relative to said body.

10. The litter container of claim 9 wherein said hinge further comprises a washer formed from a lubricious plastic disposed between said means for defining a shoulder and said body.

11. The litter container of claim 10 wherein said lubricious plastic is Teflon.

12. The litter container of claim 5 further comprising means for defining a stop which limits the pivotal motion of said top relative to said body for vertically aligning the same.

13. The litter container of claim 12 wherein said means for defining a stop comprises first and second generally vertically oriented abutments disposed on said top and said body, respectively.

14. The litter container of claim 13 wherein said means for defining a stop further includes spring clip means for releasably latching said top and said base in vertical alignment.

15. The litter container of claim 14 wherein said spring clip means comprises a male striker member disposed on one of said first and second abutments and a bifurcated leaf spring clip disposed on the other of said first and second abutments for engaging said striker when said top and said body are in vertical alignment.

16. The litter container of claim 12 wherein said vertical axis is disposed on one side of said litter container and said means for defining a stop is disposed on the opposite side thereof.

17. The litter container of claim 13 wherein said first and second abutments are disposed on the bottom and top surfaces of said top and said body, respectively, said means for defining a stop thus extending therebetween, shielded from the view of the ordinary observer.

18. The litter container of claim 1 further comprising a pivotable door disposed on the side of said top and defining a surface when said door is closed that is coextensive with the side of said top.

19. The litter container of claim 18 wherein said door is pivotally mounted about a generally horizontal axis disposed on the interior of said top for gravity biasing said door in the closed position and shielding said pivotal mounting from the view of the ordinary observer.

* * * * *